US006341385B1

(12) United States Patent
Downes

(10) Patent No.: US 6,341,385 B1
(45) Date of Patent: Jan. 29, 2002

(54) TOILET BOWL FLUID DISPENSING SYSTEM

(76) Inventor: Richard T. Downes, 8364 Jennifer La., Seminole, FL (US) 33777

( * ) Notice: Subject to any disclaimer, the term of this patent is extended or adjusted under 35 U.S.C. 154(b) by 0 days.

(21) Appl. No.: 09/588,869

(22) Filed: Jun. 6, 2000

(51) Int. Cl.[7] ..... E03D 9/03
(52) U.S. Cl. ..... 4/225.1
(58) Field of Search ..... 4/225.1

(56) References Cited

U.S. PATENT DOCUMENTS 1,893,972 A * 1/1933 Whitman ..... 222/36
5,745,928 A * 5/1998 Armanno ..... 4/225.1
6,151,722 A * 11/2000 Lubrano ..... 4/225.1

* cited by examiner

*Primary Examiner*—Charles E. Phillips

(57) ABSTRACT

A toilet bowl fluid dispensing system including a container, positioned within a toilet tank adjacent to an inlet water tube and a bowl refill tube. The bowl refill tube includes a tubular line coupling the inlet water tube and the container. The container contains threads adjacent to the upper extent. The system also includes a lid having threads adjacent to the lower extent thereof adapted to separably couple to the threads of the container. The lid also includes an inlet opening adapted to receive water from the water inlet tube for providing supplemental water to the container lid upon flushing. The lid is shaped to have a hollow member coupling to the top of the bowl refill tube for providing a positioning support to the lid and container.

1 Claim, 3 Drawing Sheets

FIG 1
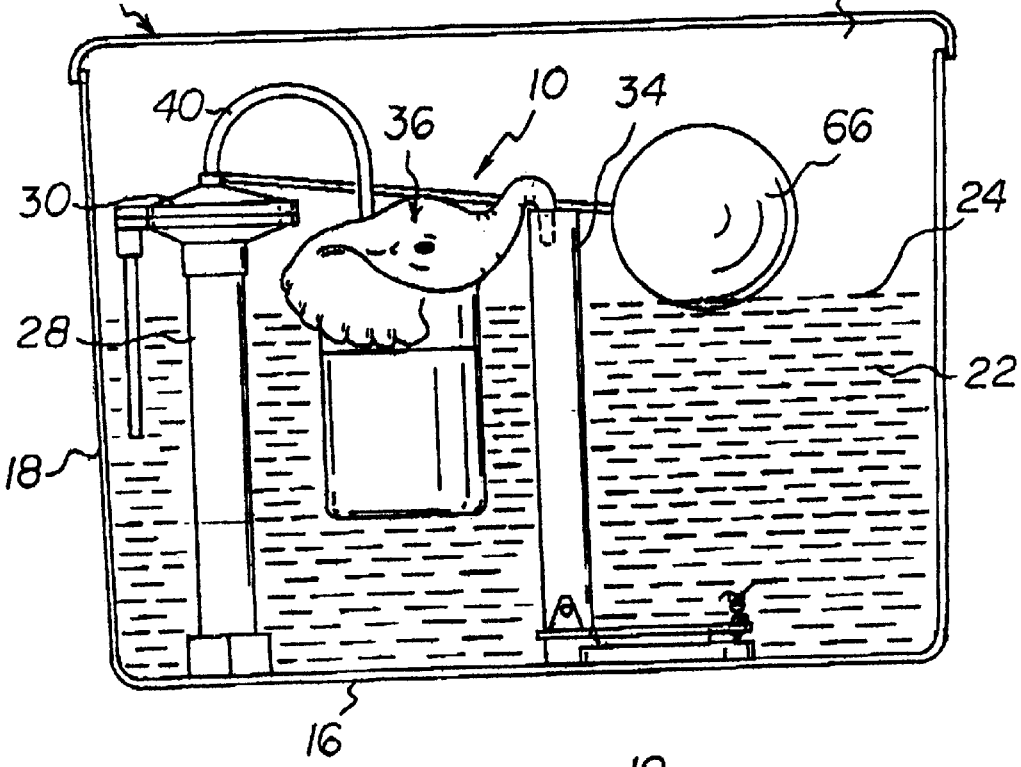
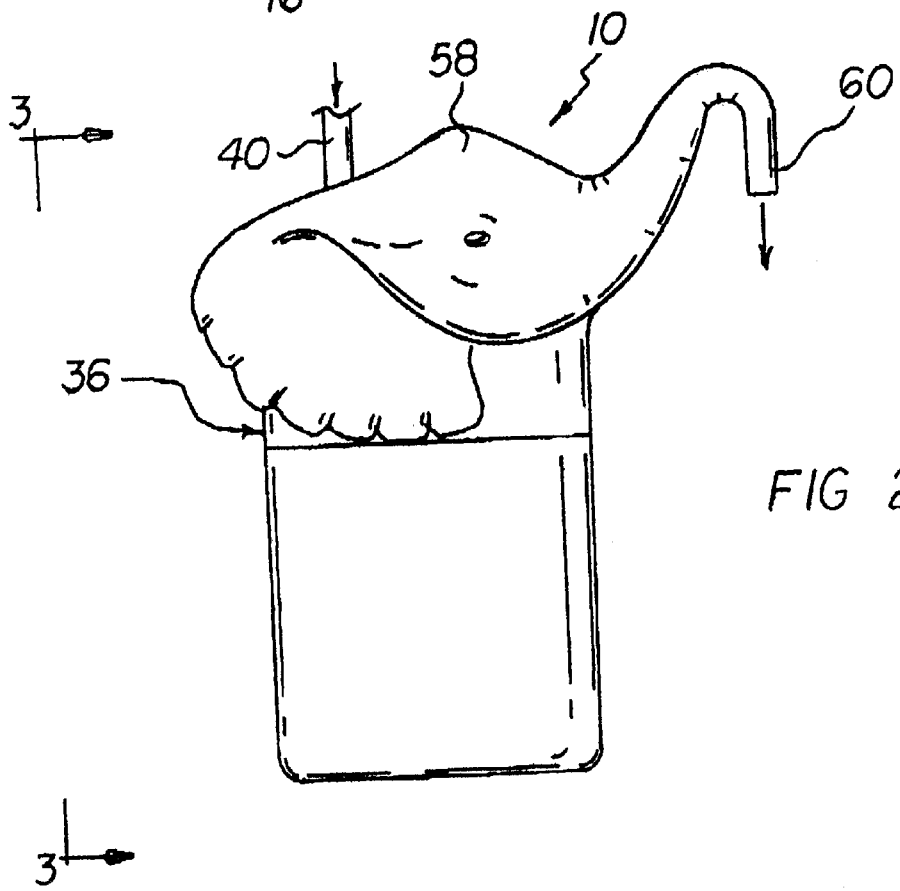
FIG 2

TOILET BOWL FLUID DISPENSING SYSTEM

BACKGROUND OF THE INVENTION

1. Field of the Invention

The present invention relates to a toilet bowl fluid dispensing system and more particularly pertains to cleaning and disinfecting toilets through the adding of chlorinated water to the bowl refill tube from the water inlet tube through an intermediate container containing a chlorine tablet.

2. Description of the Prior Art

The use of toilet cleaners of known designs and configurations is known in the prior art. More specifically, toilet cleaners of known designs and configurations previously devised and utilized for the purpose of cleaning and disinfecting toilets are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,745,928 to Armanno, Sr. discloses a toilet bowl dispensing system. U.S. Pat. No. 4,429,423 to Syrenne discloses a combination water saver and disinfectant dispenser. U.S. Pat. No. 5,778,459 to Guerin discloses a method and apparatus for injecting chemicals into the water of a toilet bowl. U.S. Pat. No. 5,042,095 to Schoepe et al. discloses a cleaner injector system. Lastly, U.S. Pat. No. 3,105,245 to Finkbiner discloses an apparatus for forming and delivering chemical solutions to toilet bowls.

While these devices fulfill their respective, particular objectives and requirements, the aforementioned patents do not describe a toilet bowl fluid dispensing system that allows cleaning and disinfecting toilets through the adding of chlorinated water to the bowl refill tube from the water inlet through an intermediate container containing a chlorine tablet.

In this respect, the toilet bowl fluid dispensing system according to the present invention substantially departs from the conventional concepts and designs of the prior art, and in doing so provides an apparatus primarily developed for the purpose of cleaning and disinfecting toilets through the adding of chlorinated water to the bowl refill tube from the water inlet through an intermediate container containing a chlorine tablet.

Therefore, it can be appreciated that there exists a continuing need for a new and improved toilet bowl fluid dispensing system which can be used for cleaning and disinfecting toilets through the adding of chlorinated water to the bowl refill tube from the water inlet through an intermediate container containing a chlorine tablet. In this regard, the present invention substantially fulfills this need.

SUMMARY OF THE INVENTION

In view of the foregoing disadvantages inherent in the known types of toilet cleaners of known designs and configurations now present in the prior art, the present invention provides a toilet bowl fluid dispensing system. As such, the general purpose of the present invention, which will be described subsequently in greater detail, is to provide a toilet bowl fluid dispensing system and method which has all the advantages of the prior art and none of the disadvantages.

To attain this, the present invention essentially comprises a toilet bowl fluid dispensing system for cleaning and disinfecting toilets. The system includes the addition of chlorinated water to the bowl refill tube from the water inlet through an intermediate container containing a chlorine tablet. The container has a lid. The lid is in the shape of an elephant's head with a hollow trunk. The lid is shaped for coupling to the bowl refill tube. A toilet tank is provided. The toilet tank is in a rectilinear configuration and has a bottom, side walls, and an open top. The toilet tank is adapted a to contain the water to be dispensed to a toilet bowl upon flushing. The toilet tank normally has an upper limit at a water line prior to flushing. The system also has a vertically disposed rigid water inlet tube. The inlet tube extends upwardly through the bottom and into the tank above the water line and has a valve at its upper extent to allow the flow of water upon flushing. The system also has a vertically disposed rigid bowl refill tube. The refill tube extends upwardly through the bottom and into the tank above the water line. The refill tube is adapted to receive water from the water inlet tube via the container and lid for replacing water lost from the tank upon flushing. The container is adapted to receive and contain a chlorine tablet and is positioned within the tank adjacent to the inlet water tube and the refill tube. A tubular line couples the inlet water tube and the lid of the container. The container has a closed bottom and an open top and a cylindrical side wall there between. The container also has threads on the side wall adjacent to the upper edge thereof. The container is adapted to be in the water of the tank with the majority of its extent beneath the water line. Next provided is a lid. The lid is formed in the shape of an elephant's head. The lid has threads at its lower extent adapted to separably couple to the threads of the container for sealing engagement therewith. The lid includes an inlet opening adapted to receive the inlet water tube from the water inlet line for thereby providing supplemental water to the container for essentially filling the container and lid upon flushing. The lid, being in the shape of an elephant's head, is formed with a hollow trunk. The trunk couples the lid to the top of the bowl refill tube for providing a positioning support between the lid and the refill tube at a contact point during operation and use. The trunk of the elephant's head contains an inlet and an outlet in the bowl refill tube with a raised intermediate extent there between. The system also contains a float ball positioned to float on the top of the water of the tank at the water line. It is adapted to fall with the flushing of the toilet. The float ball rises with the addition of water to the tank upon receipt of water into and through the bowl refill tube. An arm couples the ball and the valve for opening the valve and then closing the valve in response to the movement of the ball and the arm for thereby controlling the flow of water to the tank as well as the dispensing of chlorine.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a toilet bowl fluid dispensing system which has all of the advantages of the prior art toilet cleaners of known designs and configurations and none of the disadvantages.

It is another object of the present invention to provide a toilet bowl fluid dispensing system which may be easily and efficiently manufactured, marketed, and installed.

It is further object of the present invention to provide a toilet bowl fluid dispensing system which is of durable and reliable constructions with ease of installation for consumers.

An even further object of the present invention is to provide a toilet bowl fluid dispensing system which is susceptible of a low cost of manufacture with regard to both materials and labor, and which accordingly is then susceptible of low prices of sale to the consuming public, thereby making such toilet bowl fluid dispensing system economically available to the buying public.

Even still another object of the present invention is to provide a toilet bowl fluid dispensing system for cleaning and disinfecting toilets through the adding of chlorinated water to the bowl refill tube from the water inlet through an intermediate container containing a chlorine tablet.

Lastly, it is an object of the present invention to provide a toilet bowl fluid dispensing system including a container, positioned within a toilet tank adjacent to an inlet water tube and hooked onto a bowl refill tube. A tubular line couples the inlet water tube and the container. The container has threads adjacent to its upper edge. The system also includes a lid having threads adapted to separably couple to the threads of the container. The lid includes an inlet opening adapted to receive water from the water inlet line for providing supplemental water to the container upon flushing. The lid is shaped to have a hollow member formed at an intermediate extent of the lid. The top of the bowl refill tube provides an important positioning support for the hollow member. The hollow member contains an inlet in the lid and an outlet in the bowl refill tube and a raised intermediate extent there between.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevatational view of the toilet bowl fluid dispensing system for cleaning and disinfecting toilets through adding of chlorinated water to the bowl refill tube with certain parts shown in cross sectional configuration.

FIG. 2 is a front elevational view of the elephant's head and container shown in FIG. 1.

FIG. 5 is an exploded perspective view of the container and lid with a chlorine tablet there between.

The same reference numerals refer to the same parts throughout the various Figures.

DESCRIPTION OF THE PREFERRED EMBODIMENT

Figure 3:
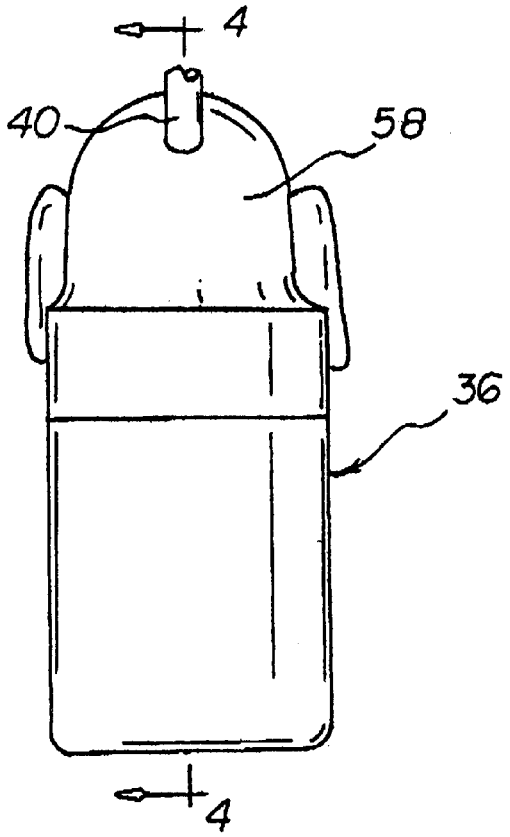
FIG. 3 is a left side elevational view taken along line 3—3 of FIG. 2.
Figure 4:
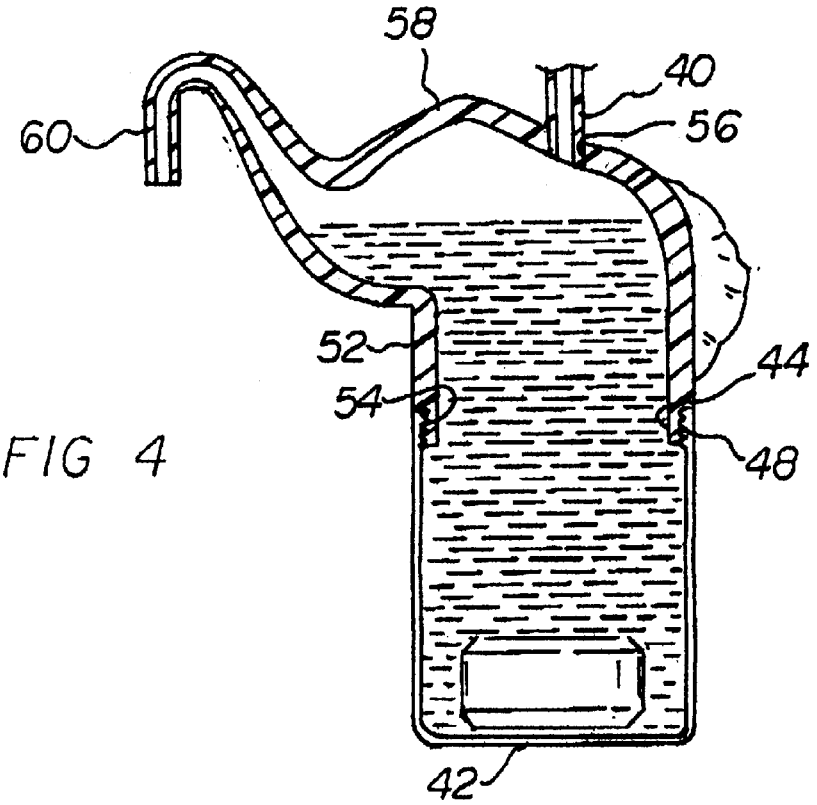
FIG. 4 is a cross sectional view taken along line 4—4 of FIG. 3.
Figure 5:
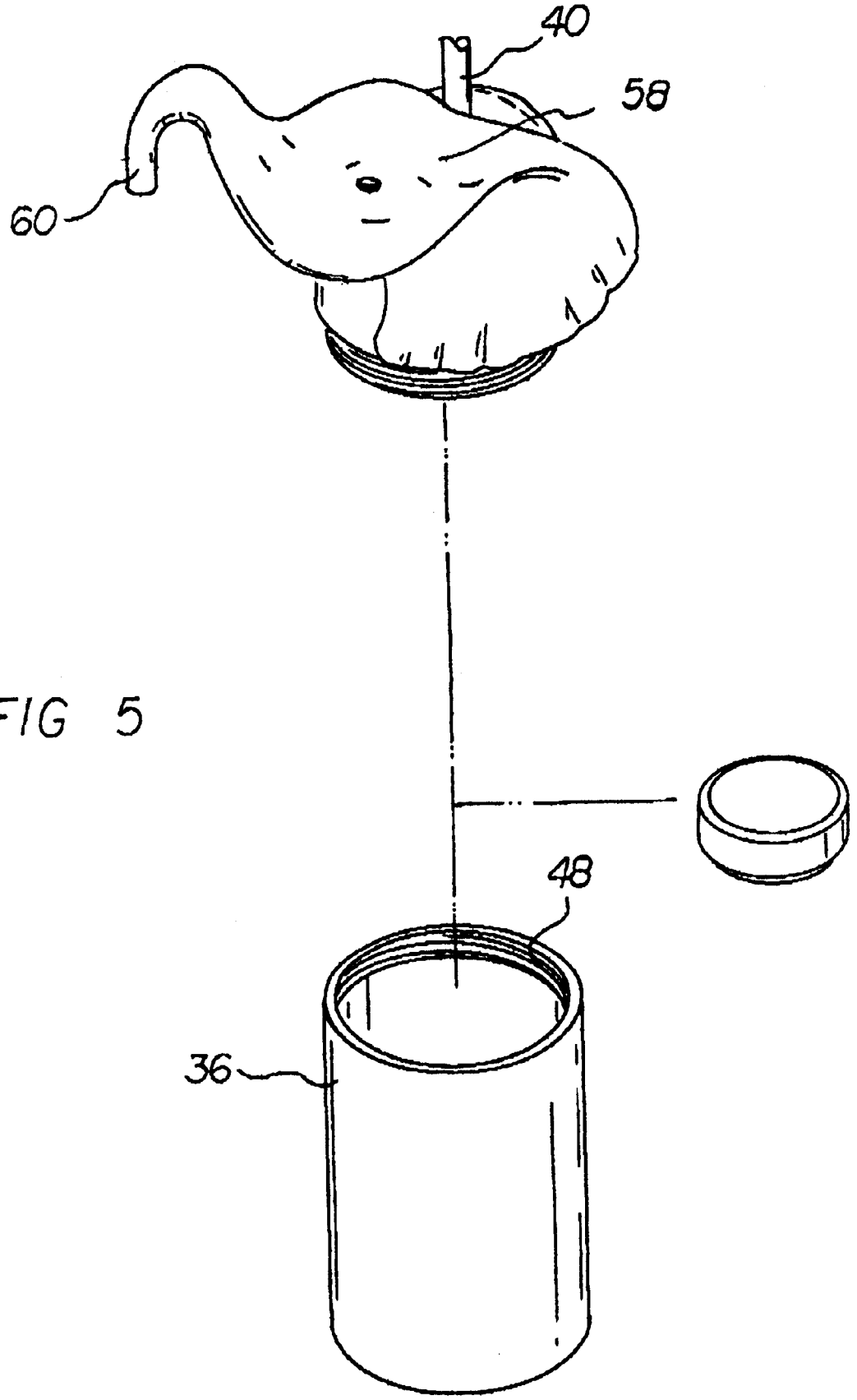

With reference now to the drawings, and in particular to FIG. 1 thereof, the preferred embodiment of the toilet bowl fluid dispensing system embodying the principles and concepts of the present invention and generally designated by the reference numeral 10 will be described.

The present invention, the toilet bowl fluid dispensing system 10 comprises a plurality of components. Such components in their broadest context include a toilet tank, a vertically disposed rigid water inlet tube, a vertically disposed rigid bowl refill tube, a container, a lid and a float ball. Such components are individually configured and correlated with respect to each other so as to attain the desired objective.

First provided is a toilet tank 14 in a rectilinear configuration having a bottom 16, side walls 18, and an open top 20. The open top is adapted to support the water 22 to be dispensed to a toilet bowl upon flushing. The water normally has an upper limit at a water line 24 prior to flushing.

The system also has a vertically disposed rigid water inlet tube 28. The inlet tube extends upwardly through the bottom and into the tank above the water line. It has a valve 30 at its upper extent to allow the flow of water upwardly upon flushing.

The system also has a vertically disposed rigid bowl refill tube 34. The refill tube extends upwardly through the bottom and into the tank above the water line. The refill tube is adapted to receive water from the water inlet tube with a container and lid for replacing water lost from the tank upon flushing.

A container 36 is adapted to receive and contain a chlorine tablet. It is positioned within the tank adjacent to the inlet water tube and refill tube. A tubular line 40 couples the inlet water tube and the container via the lid of the container. The container is in the form of an elephant's head and includes a closed bottom 42 and an open top 44 with a cylindrical side wall there between. Threads 48 are formed in the side wall adjacent to the upper edge thereof. The container is adapted to be positioned in the water of the tank with the majority of its extent beneath the water line.

The system also includes a lid 52, preferably in the shape of the head of an elephant, and including a trunk in an inverted U-shaped configuration. Threads 54 are formed in the lower extent of the lid and are adapted to separably couple to the threads of the container for sealing engagement therewith. The threads on the lid and container are complimentary and may be internal and/or external as a function of the desired application. The threads on the lid and container are complimentary and may be internal and/or external as a function of the desired application. The lid includes an inlet opening 56 adapted to receive water from the inlet water tube through a line for providing supplemental water to the container for essentially filling the container and lid upon flushing the toilet. The lid in the preferred embodiment is in the shape of a hollow elephant's head 58 and includes a hollow trunk 60. The trunk of the elephant's head extends from an intermediate extent of the lid to the top of the bowl refill tube for providing a positioning support between the bowl refill tube and the lid as well as the container during operation and use. The trunk of the elephant contains an inlet in the head and an outlet extending into the bowl refill tube with a raised intermediate extent there between. The trunk of the elephant's head is generally rigid and hooks over the free upper open end of the refill tube with no supplemental clip or the like required during operation and use. The entire trunk is laterally offset from the water inlet tube within the lid. In this manner water flowing into the container and lid will raise the water level within the container and lid to the trunk whereby water will flow out through the trunk of the container by the created water pressure. The end of the trunk fills less than 50 percent of the opening of the refill to allow overflow water to flow there through.

The system also contains a float ball 66 positioned to float on the top of the water of the tank. It is adapted to fall with the flushing of the toilet. The float ball rises with the addition of water to the tank upon receipt of water into the bowl refill tube. An arm 68 couples the ball and the valve for opening the valve and then closing the valve in response to the movement of the ball and the arm. This thereby controls the flow of water to the tank as well as the dispensing of chlorine.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A toilet bowl fluid dispensing system for cleaning and disinfecting toilets through the adding of chlorinated water to the bowl refill tube from the water inlet through an intermediate container containing a chlorine tablet with the container having a lid shaped for coupling to the bowl refill tube comprising, in combination:

a toilet tank in a rectilinear configuration with a bottom, side walls, and an open top adapted to support water to be dispensed to a toilet bowl upon flushing, the water normally having an upper limit at a water line prior to flushing;

a vertically disposed rigid water inlet tube, extending upwardly through the bottom and into the tank above the water line and having a valve at its upper extent to allow the flow of water upon flushing;

a vertically disposed rigid bowl refill tube extending upwardly through the bottom and into the tank above the water line and adapted to receive water from the water inlet tube for replacing water lost from the tank upon flushing;

a container adapted to receive and contain a chlorine tablet, the container being positioned within the tank adjacent to the inlet water tube and the bowl refill tube with a tubular line coupling the inlet water tube and the container, the container having a closed bottom and an open top with a cylindrical side wall there between and a coupling component on the side wall adjacent to the upper edge thereof, the container adapted to be in the water of the tank with the majority of its extent beneath the water line;

a lid having a coupling component at its lower extent adapted to separably couple to the coupling component of the container for sealing engagement therewith, the lid having an inlet opening adapted to receive the end of the inlet water tube from the water inlet line for providing supplemental water to the container for essentially filling the container and the lid upon flushing, the lid being hollow and in the shape of an elephant's head and formed to include a hollow trunk, extending laterally from an intermediate portion of the lid coupling the lid to the top of the bowl refill tube for providing a positioning support between the lid and the refill tube at a contact point on the refill tube during operation and use, the trunk having an inlet and a vertically oriented outlet positioned in the bowl refill tube with a raised inverted U-shaped intermediate extent there between and hooked over the free upper end of the refill tube; and a float ball positioned to float on the top of the water of the tank at the water line and adapted to fall with the flushing of the toilet and to rise with the addition of water to the tank upon receipt of water into and through the bowl refill tube and with an arm coupling the float ball and the valve for opening the valve and then closing the valve in response to the movement of the ball and the arm for thereby controlling the flow of water to the tank as well as the dispensing of chlorine.

* * * * *